US007380674B2

(12) United States Patent
Vaine

(10) Patent No.: US 7,380,674 B2
(45) Date of Patent: Jun. 3, 2008

(54) METHOD OF PROCESSING AND SORTING AGGREGATE MATERIAL

(76) Inventor: Norman Vaine, 449 N. Mine Ledge Rd., Surry, NH (US) 03431

( * ) Notice: Subject to any disclaimer, the term of this patent is extended or adjusted under 35 U.S.C. 154(b) by 93 days.

(21) Appl. No.: 11/511,083

(22) Filed: Aug. 28, 2006

(65) Prior Publication Data

US 2008/0047878 A1 Feb. 28, 2008

(51) Int. Cl.
*E02F 3/40* (2006.01)

(52) U.S. Cl. ..... 209/420; 209/421; 37/431; 37/444

(58) Field of Classification Search ..... 209/420, 209/421; 37/409, 431, 444, 445, 903; D15/25
See application file for complete search history.

(56) References Cited

U.S. PATENT DOCUMENTS 3,072,257 A * 1/1963 Hockenberry ..... 171/132
3,765,490 A * 10/1973 Logue ..... 171/132
5,241,764 A * 9/1993 Modig ..... 37/405
5,311,684 A * 5/1994 Van Dalfsen ..... 37/409
5,528,844 A * 6/1996 Ellis ..... 37/403
5,743,030 A * 4/1998 Sirr ..... 37/406
5,771,612 A * 6/1998 Lynch ..... 37/142.5
5,964,050 A * 10/1999 Svahn ..... 37/409
6,375,012 B1 * 4/2002 Leyland et al. ..... 209/421
7,284,345 B2 * 10/2007 Schenk ..... 37/403

* cited by examiner

*Primary Examiner*—Joseph Rodriguez
(74) *Attorney, Agent, or Firm*—Bourque & Associates

(57) ABSTRACT

A method of processing and sorting aggregate materials includes providing an aggregate material processing device which has aggregate material holding region having an opening over which may be pivotably and removably placed an aggregate material sorting device. The method involves causing the aggregate material processing device to engage with a supply of unsorted aggregate material such that the unsorted aggregate is forced over the aggregate material sorting device thereby causing some of the unsorted aggregate material to fall through the sorting device and into the aggregate material holding region while some of the unsorted aggregate material remains on a top region of the aggregate material sorting device. The aggregate material processing devices than displaced horizontally to a first position where the aggregate material holding device is displaced vertically and the aggregate material located on top of the storing device is allowed to fall into a first pile of sorted aggregate material whereby the aggregate material processing devices further move to a second location where the aggregate material holding device is further displaced vertically to cause the aggregate material sorting device to move away from the opening and any material located in the holding device falls into a second pile of sorted aggregate material.

10 Claims, 6 Drawing Sheets

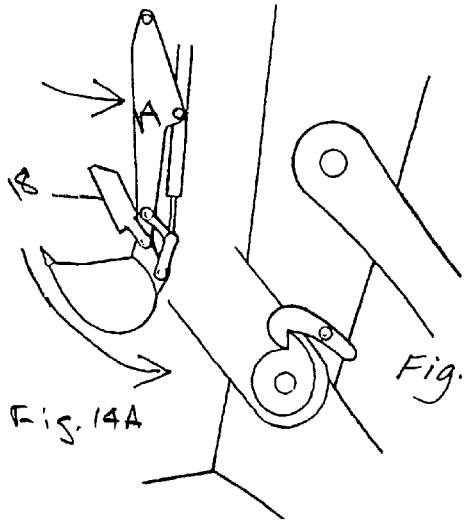
Fig. 14A
Fig. 14B
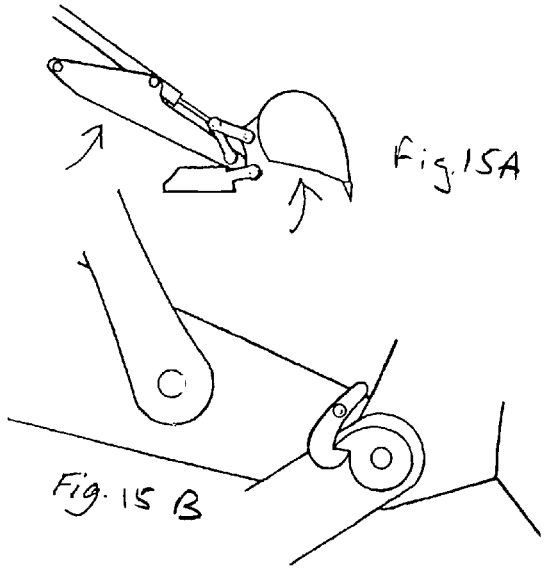
Fig. 15A
Fig. 15 B
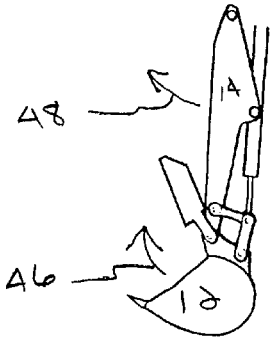
Fig. 16 A
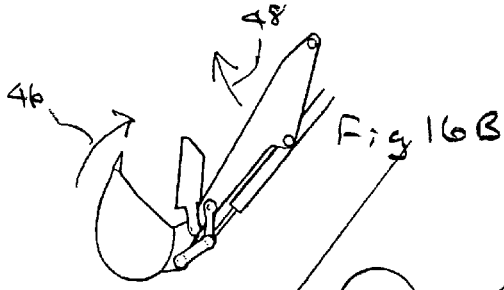
Fig. 16B
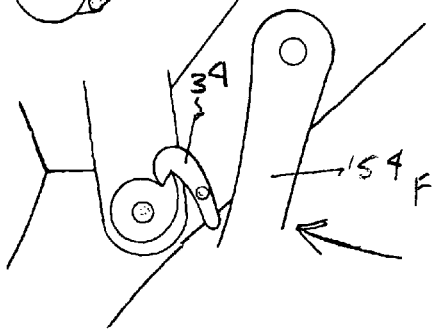
Fig. 16C

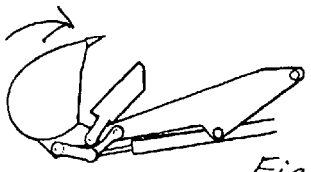
Fig. 17
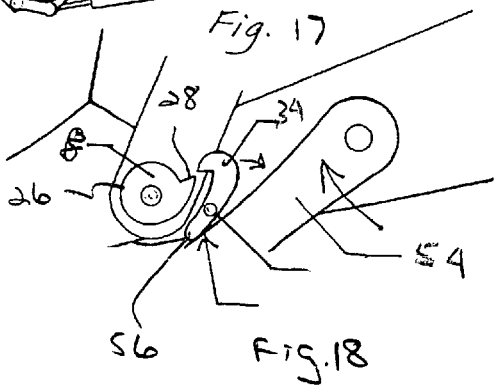
Fig. 18
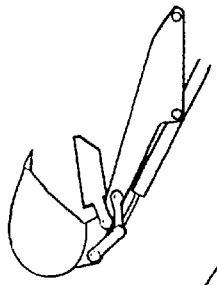
Fig. 19A
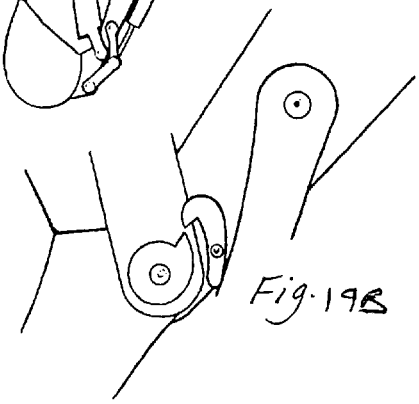
Fig. 19B
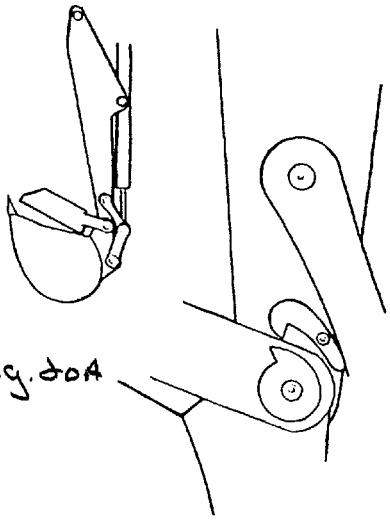
Fig. 20A
Fig. 20B
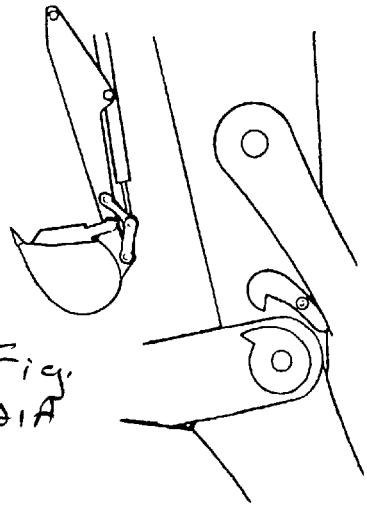
Fig. 21A
Fig. 21B

METHOD OF PROCESSING AND SORTING AGGREGATE MATERIAL

TECHNICAL FIELD

The present invention relates to the processing of aggregate material such as gravel and other rock or particulate laden material and more particularly, to a method of utilizing a screen on an excavator bucket or similar device to quickly and easily process and sort the aggregate material.

BACKGROUND INFORMATION

It is quite common in the processing of aggregate material such as gravel, loam, sand, stones, and other earth material that the material must be sorted or processed according to the size of rocks or other debris which is found in the material. Prior art systems and methods have dealt extensively with this problem however, to date, no solution has been provided which provides a method of easily and quickly utilizing the normal digging action of aggregate material processing equipment such as an excavator or loader, to screen or processed the aggregate material.

For example, many prior art solutions have included providing a screen along the top or entrance portion of the aggregate processing equipment. Using this equipment and method, the aggregate processing equipment fills a hopper such as a loader or excavator with material to be processed. Next, a screen or other similar restriction is placed on top of the entrance to the excavation equipment. The aggregate equipment processor hopper is then tilted such that gravity causes the aggregate contained in the hopper to spill out of the hopper. Only that the aggregate material which is small enough to fit between and through the screen or other restriction placed on top of the entrance of the hopper escapes. What remains in the hopper is aggregate material which is larger than the screen or restriction. The aggregate processing equipment must then be moved to a different pile to empty what remains in the hopper.

Although in theory this system and method works, a significant amount of activity and movement of the excavation equipment hopper is required in order to force the smaller aggregate material past the larger aggregate material and through the screen or restriction placed at the entrance to the hopper. This takes a considerable amount of time and activity by the equipment operator. Moreover, the excavator must be modified and fitted with additional hydraulics including pipes, fittings, hoses, valves, cylinders, controls, etc. in order to use such equipment.

In another prior art system and method, a screen, forks or other similar aggregate sizing element is placed in the bottom of the hopper. The hopper is next filled with aggregate material to be processed. Subsequently, the screen or forks are moved mechanically through the entire contents of the aggregate material found in the hopper. Only material which is too large to pass through the screen or forks remains on top of the screen or forks. The operator of the aggregate processing equipment must then move the equipment in one location and carefully allow the larger aggregate to fall into one pot and then subsequently moved the equipment to another position to dump the contents of the hopper which has been screen.

Other various methods which combine the prior art techniques described above or our slight variations on these techniques have also been attempted. Unfortunately, such prior art attempts have fallen short of an ideal aggregate processing method in that they require multiple operator steps and at times require the operator to significantly shake or moves the excavation equipment for the sorting and processing to take place. The fact that the prior art methods take significant additional time and requires significantly more modification translates into significant additional costs for processing aggregate material since the cost of an equipment operator as well as the cost of an operating piece of equipment are not insubstantial.

Accordingly, a need exists for a quick and simple method for using a piece of excavation equipment to process and sort aggregate material.

SUMMARY

The present invention includes a method of processing and sorting aggregate material. The method begins by providing an aggregate material processing device. The aggregate material processing device includes an aggregate material holding region having a defined opening and an aggregate material size sorting device configured to be pivotably and removably placed over said defined opening of the material holding region of the aggregate material processing device. In the preferred embodiment, the aggregate material processing device is an excavator and the holding device is an excavator bucket, while the aggregate material size sorting device is a screen or grate. At least the aggregate material holding region is configured to be moved between an aggregate material holding region filling position, a first aggregate material sorting position and a second aggregate material sorting position.

The method further includes causing the aggregate material processing device to move into an aggregate material holding region filling position whereby at least the aggregate material holding region engages with a supply of unsorted aggregate material such that at least a portion of said unsorted aggregate material is forced over the aggregate material size sorting device thereby causing some of the unsorted aggregate material to fall through the aggregate material size sorting device into said aggregate material holding region and some of the unsorted aggregate material to remain on a top region of the aggregate material size sorting device disposed in said opening of the aggregate material holding region.

The method further includes the act of causing the aggregate material processing device to be displaced, horizontally, from a location proximate the supply of unsorted aggregate material to a first location. Next, the aggregate material processing device is caused to move in a vertical direction a first amount into the first aggregate material sorting position so as to cause the aggregate material remaining on the top region of the aggregate material sized sorting device to fall into a first sorted aggregate material store at the first location.

Next, the aggregate material processing device is caused to be displaced, horizontally, from a location proximate the first sorted aggregate material store to a second location. Finally, the aggregate material processing device is caused to be moved in a vertical direction a second amount greater than the first amount whereby the aggregate material processing device is moved into the second aggregate material sorting position causing the aggregate material sized sorting device to be pivotably displaced away from the material holding region opening and further causing the sorted aggregate material located in the aggregate material holding region to fall from the aggregate material holding region into a second sorted aggregate material store at the second location.

In the preferred embodiment, the excavator bucket is configured to pivot about an axis coupling the excavator bucket to a support arm wherein pivoting the excavator bucket about this axis causes the excavator bucket to move between an aggregate material holding region filling position, the first aggregate material sorting position and the second aggregate material sorting position. The excavator bucket further preferably includes an aggregate material size sorting device retainer, configured to engage the aggregate material size sorting device, for maintaining the aggregate material size sorting device in a position generally way from the defined opening of the excavator bucket. The aggregate material size sorting device retainer typically includes a dog ear and a spring loaded latch.

In another embodiment, the present invention further includes after the act of causing the aggregate material processing device to move in a vertical direction into the second aggregate material sorting position causing the sorted aggregate material located in the aggregate material holding region to fall from the aggregate material holding region, the act of causing the excavator bucket to move about the axis toward the support arm and into a third position whereby the aggregate material size sorting device moves toward the support arm and engages with the aggregate material size sorting device retainer, to maintain the aggregate material size sorting device against the support arm and away from the defined opening of the excavator bucket.

The screen may be disengaged and placed back into a useable position by providing an aggregate material size sorting device retainer release, disposed on the support arm, and configured to contact the aggregate material size sorting device retainer, for releasing the retainer and allowing the aggregate material size sorting device to move into position in the opening of the excavator bucket. The user next moves the excavator bucket toward the support arm into a fourth position generally adjacent the support arm, such that the aggregate material size sorting device retainer release contacts the aggregate material size sorting device retainer thereby releasing it. The Excavator bucker is then moved away from the support arm toward the filling position thereby causing the aggregate material sized sorting device to pivotably move to a position over the defined opening of the excavator bucket.

It is important to note that the present invention is not intended to be limited to a system or method which must satisfy one or more of any stated or implied objects or features of the invention. It is also important to note that the present invention is not limited to the preferred, exemplary, or primary embodiment(s) described herein. Modifications and substitutions by one of ordinary skill in the art are considered to be within the scope of the present invention, which is not to be limited except by the allowed claims and their legal equivalents.

BRIEF DESCRIPTION OF THE DRAWINGS

These and other features and advantages of the present invention will be better understood by reading the following detailed description, taken together with the drawings wherein:

FIGS. 14A-14B and 15A-15B are side in the use illustrating use of the aggregate material processing device without use of the aggregate material sorting device which is locked into position out of the way out of the way of the bucket;

FIGS. 16A-16C are side views illustrating the movement required to begin positioning the aggregate material bucket to release the aggregate material sorting device in position against the bucket;

FIG. 17 is a side view illustrating the movement of the bucket required to release the aggregate material size sorting device retainer;

FIG. 18 is a side view illustrating the aggregate material size sorting device retainer contacting a release to disengage the retainer from the size sorting device;

FIGS. 19A-19B are side views illustrating release of the aggregate material size sorting device retainer;

FIGS. 20A-20B and 21A-21B are side views illustrating the aggregate material size a sorting device and retainer returning to a first position in place over the bucket.

DETAILED DESCRIPTION OF THE PREFERRED EMBODIMENTS

Figure 1:
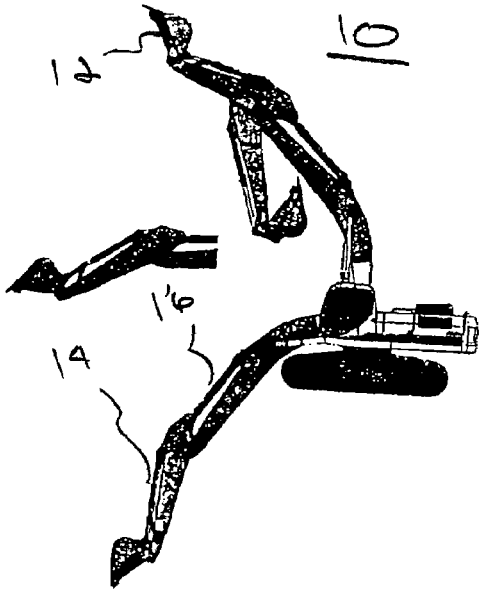
Fig. 1 (Prior Art)
FIG. 1 is schematic view of a prior art excavator which is utilized to explained the method of the present invention.

The present invention features a method for processing and sorting aggregate material, such as gravel, using an aggregate material processing device. In the preferred embodiments, and for purposes of explaining the present invention, one type of aggregate material processing device which is well suited and adapted for use with the present invention is excavator 10, FIG. 1, wherein is shown the general range of motion for the excavator bucket 12 and support arms 14, 16.

Figure 2:
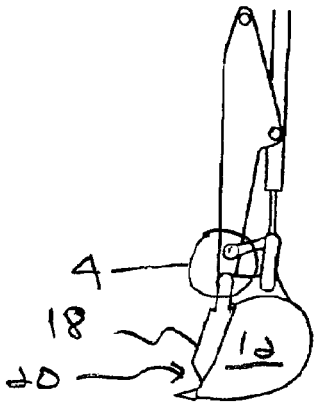
FIG. 2 is a more detailed schematic view of an aggregate material processing device in the form of an excavator bucket on which has been installed an aggregate material size sorting device in accordance with the teachings of the present invention.
Figure 3:
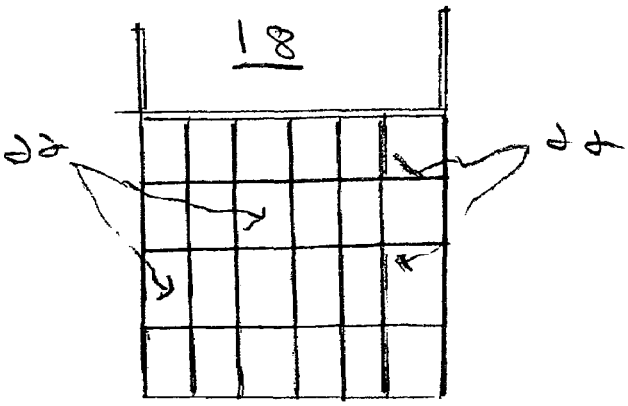
FIG. 3 is a schematic top view of an aggregate material size sorting device in accordance with the present invention.

The present invention requires the addition of an aggregate material size sorting device 18, FIG. 2 which is placed over the defined opening 20 in an aggregate material holding region herein described as an excavator bucket 12. As shown in greater detail in FIG. 3, the aggregate material size sorting device 18 is provided in the form of a screen or grate having a number of openings 22 which are sized based on the sorting desired by the user. The smaller the openings 22 the more refined the sorted aggregate material will be. As one can readily appreciate, the size of the openings 22 can be modified to suit the material sorting and sizing requirements of the user. The aggregate material size sorting device 18 is preferably made from metal rods or bars having sufficient size and strength to withstand the digging process, as will be explained in greater detail below.

Figure 4:
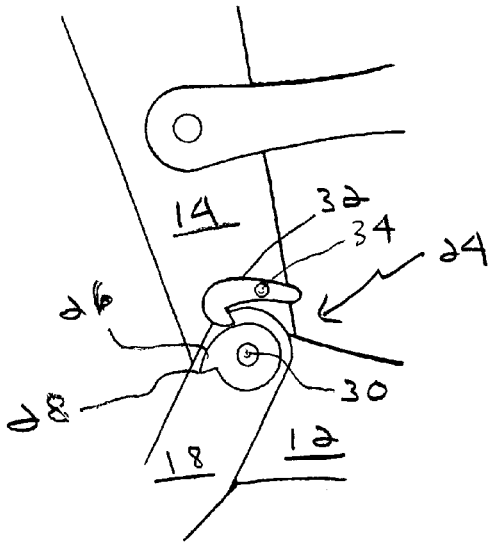
FIG. 4 is a side view of the aggregate material size sorting device retainer in accordance with the present invention.

As shown in greater detail in FIG. 4, the present invention includes, in the preferred embodiment, providing an aggregate material size sorting device retainer mechanism 24 which includes a rotatable mechanism 26 having a "dog ear" region 28. The rotatable mechanism 26 is fixed to the aggregate material size sorting device 18, both of which pivot and rotate about pin 30 which, in the present embodiment, connects the excavator bucket 12 to the support arm 14. The retainer mechanism 24 also includes a spring loaded latch 32 which is spring-loaded to pivot about axis 34 and operates as will be described in greater detail below in connection with the rotatable mechanism 26, to hold the screen 18 away from the bucket 12 when the aggregate material sorting device is not in use.

Figure 5:
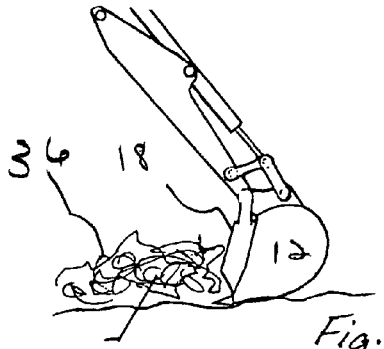
FIG. 5 is a side view of the use of the aggregate material processing device along with the aggregate material size sorter device being used with a supply of unsorted aggregate material in accordance with one act all of the present invention.
Figure 6:
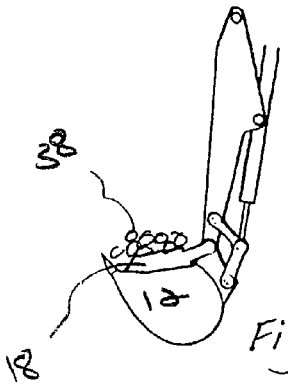
FIG. 6 is a side view of an aggregate material processing device including some sorted aggregate material.

FIGS. 5 and 6 illustrate the steps of providing an aggregate material processing device namely, for exemplary purposes, an excavator bucket 12 which has been fitted with a pivotably removable aggregate material size sorting device 18 in the form of a screen. The first step of the present method is to cause an aggregate material holding device 12 which has been fitted with the screen 18 through a supply of unsorted aggregate material 36. Using this method and the aggregate material size sorting device 18, all of the unsorted aggregate material 36 which is smaller than the openings 22 in the screen 18 will enter the bucket 12 while the larger aggregate material 38 FIG. 6 will remain on top of the screen 18 once the bucket 12 is moved through the unsorted aggregate material 36 into a generally horizontal position.

Figure 7:
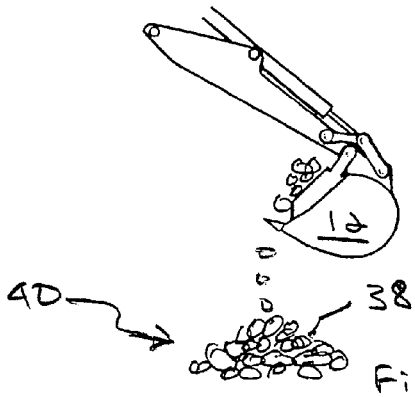
FIG. 7 is a side view of an aggregate material processing device in the act of being positioned in a first location to deposit a first type of sorted aggregate material.
Figure 8:
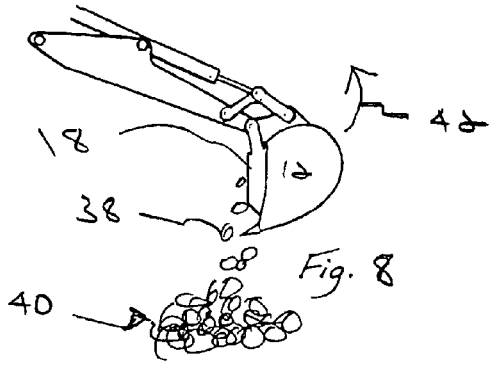
FIG. 8 is a side view of an aggregate material processing device in the act of depositing a first type of sorted aggregate material and a first location.

Next, the aggregate processing device will be moved to a first sorting location and the bucket 12 is tipped slightly, FIG. 7, to approximately a 45° angle, causing the larger now sorted aggregate material 38 to fall off of the top of the screen 18 into a pile 40. The bucket 12 is moved further in the direction generally of arrow 42, FIG. 8 until all of the larger aggregate 38 falls off of the screen 18 and into the pile 40.

Figure 9:
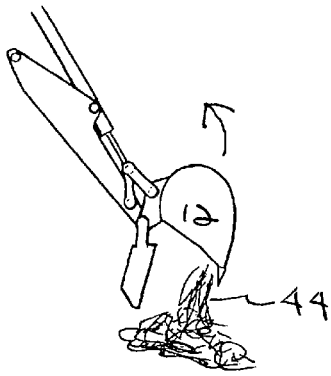
FIG. 9 is a side view of an aggregate material processing device positioned in a second location in the act of depositing a second type of sorted aggregate material.

The aggregate material processing device is next moved to a second sorting location and the aggregate holding device or bucket 12, FIG. 9, is tipped or inclined even more vertically which causes the contents 44 of the aggregate material holding device or bucket 12 to spill out of the bucket 12 and into a second pile. The contents 44 are a second sorted aggregate material having a size smaller than the size of the openings 22 in the screen or grill 18.

It will be obvious to those skilled in the art that the steps taken and illustrated by FIGS. 5 through 9 are normal aggregate processing actions taken by an aggregate material processing device, such as an excavator. Accordingly, no new steps need to be learned by an equipment operator. By providing the screen 18 at the top of the bucket 12 and by utilizing this screen prior to engaging the bucket 12 with a supply of unsorted aggregate material 36, ensures that all of the smaller aggregate material will fall in the bucket while the larger material 38 will remain on top of the screen. This larger material 38 can be easily dumped into one pile after the bucket is moved and the sorted aggregate material is easily and quickly dumped into a second pile.

One feature of the present invention is the ability to place the aggregate material size sorting device or screen 18 out of the way when it is desired not to use this feature of the aggregate material processing device. The utilization of this feature requires, in a further embodiment, the use of an aggregate material size sorting device retainer and movement of the aggregate material processing device in a certain manner. These steps are illustrated and FIGS. 10 through 13.

Figure 10:
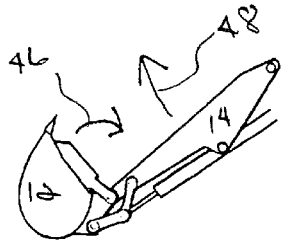
FIG. 10 is a side view of an aggregate material processing device being positioned to lock the aggregate material size sorting device away from the bucket.
Figure 12A:
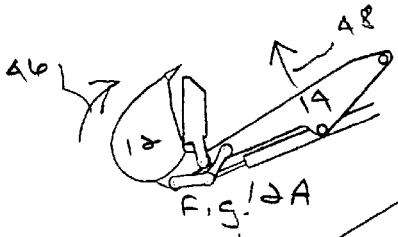
FIGS. 12A and 12B are side views of the aggregate material retaining device moving further towards the locked position.
Figure 11:
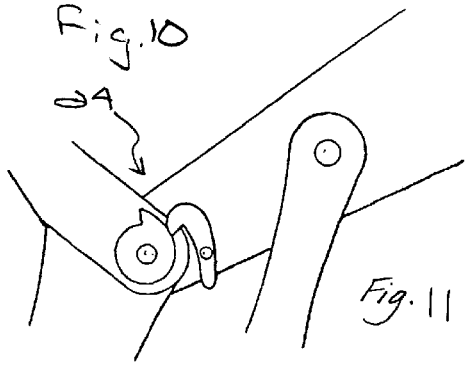
FIG. 11 is a side view of the aggregate material size sorting device retainer moving towards the locked position.
Figure 12B:
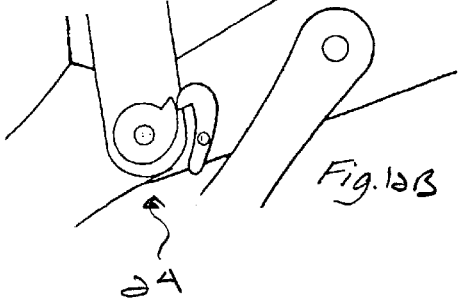

The first step in disengaging the screen 18 and placing it out of the way is shown in FIG. 10. In this act, the bucket 12 is curled up inwardly as shown generally by arrow 46 while support on 14 is moved upwardly in the direction indicated generally by arrow 48. In this position shown in FIG. 10, the retainer device 24 is in the position shown generally in FIG. 11. The method requires the user to continue to further curl the bucket 12 toward the support arm 14 in the direction shown by arrow 46, FIG. 12A. This results in the retainer device 24 moving more towards a locked position, FIG. 12B.

Figure 13:
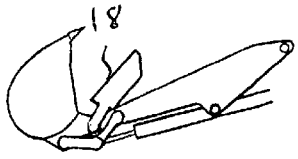
FIGS. 13A-13C are side views showing the aggregate material size sorting device being locked against the support member by the retainer device.
Figure 13B:
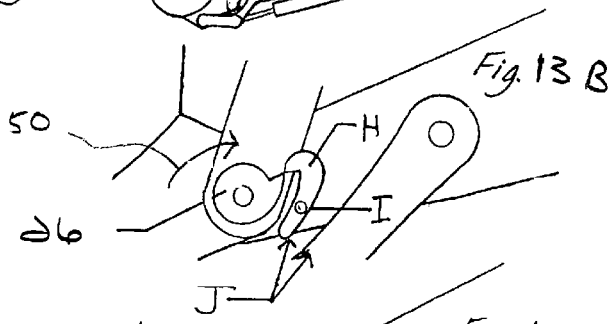
Figure 13C:
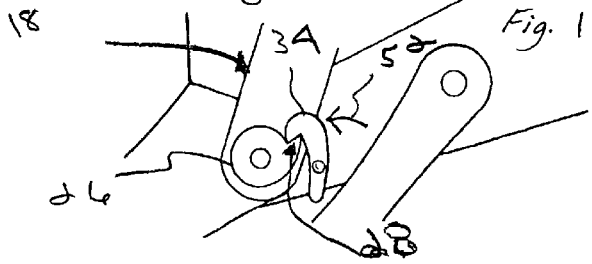
Figure 22A:
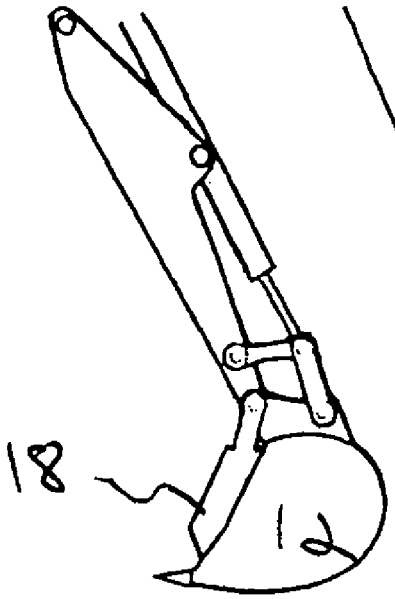
FIGS. 22A-22B are side views illustrating the aggregate material size sorting device back in position and in place over the opening of the aggregate material holding area.
Figure 22B:
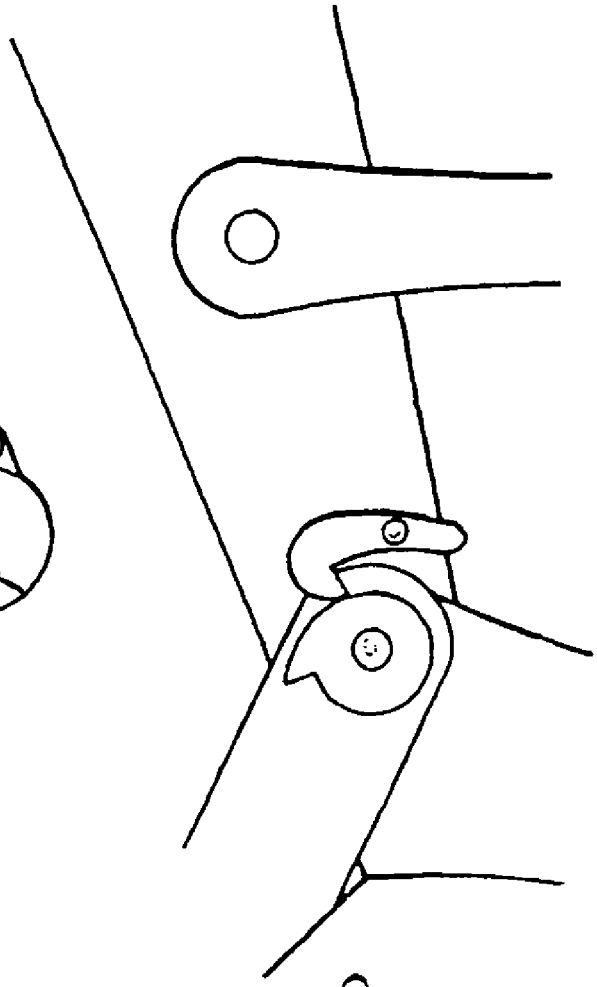

Eventually, gravity will act on the screen 18 and cause it to fall onto the support arm 14, FIG. 13A. the pivoting of the screen 18 results in the pivoting of the rotatable mechanism 26, FIG. 13B as shown generally by arrow 50. Eventually, spring-loaded latch 32, FIG. 13C, will move in the direction indicated generally by arrow 52 causing it to engage with the dog ear 28 of the rotatable mechanism 26. This will lock the screen 18 generally against the support arm 14 allowing the bucket to be used in a normal fashion without the screen. This is illustrated generally in FIGS. 14A, 14B, 15A and 15B.

When a user again desires to utilize the aggregate size sorting device 18, the user again curls the bucket 12 toward the support arm as indicated generally by arrow 46, FIG. 16A while support arm 14 is moved upwardly in a direction generally indicated by arrow 48, FIG. 16B. This movement continues until brace 54, FIG. 16C, begins to contact latch 32. At this point, FIG. 17, brace 54, FIG. 18, begins to contact one end 56 of the spring-loaded latch 32 causing latch 32 to disengage with the dog ear 28 of the retainer mechanism 26. This allows the screen 18 to rotate downwardly back into position over the opening of the bucket 12, FIGS. 19 through 22. The sorting device or screen 18 may now be utilized in accordance with the method described herein.

Accordingly, the present invention provides a novel method for processing and sorting aggregate material which utilizes the normal actions of an aggregate processing device such as an excavator in combination with a screen or other similar great serving as an aggregate sorting device which is placed over the opening of an excavator bucket or other aggregate material holding device. After engaging the aggregate material processing device with a supply of unsorted aggregate material, a first type or size of sorted aggregate material will remain on the top of the screen while smaller material will fall into the bucket. Both sizes of sorted aggregate material can be easily and quickly dumped into their respective piles for future use.

It is important to note that the present invention is not intended to be limited to a system or method which must satisfy one or more of any stated or implied objects or features of the invention. It is also important to note that the present invention is not limited to the preferred, exemplary, or primary embodiment(s) described herein. The present invention has been described in connection with a gravel excavator but other types of aggregate material as well as other types of aggregate material processing devices are contemplated by the present invention and those of ordinary skill in the art would know and readily understand how to so adapt and configure the invention. Modifications and substitutions by one of ordinary skill in the art are considered to be within the scope of the present invention, which is not to be limited except by the allowed claims and their legal equivalents.

The invention claimed is:

1. A method of processing and sorting aggregate material, the method comprising the acts of:

providing an aggregate material processing device, said aggregate material processing device including an aggregate material holding region having a defined opening and an aggregate material size sorting device configured to be pivotably and removably placed over said defined opening of said material holding region of said aggregate material processing device, at least said aggregate material holding region configured to be moved between an aggregate material holding region filling position, a first aggregate material sorting position and a second aggregate material sorting position;

causing said aggregate material processing device to move into said aggregate material holding region filling position whereby at least said aggregate material holding region engages with a supply of unsorted aggregate material such that at least a portion of said unsorted aggregate material is forced over said aggregate material size sorting device thereby causing some of said unsorted aggregate material to fall through said aggregate material size sorting device into said aggregate material holding region and some of said unsorted aggregate material to remain on a top region of said aggregate material size sorting device disposed in said opening of said aggregate material holding region;

causing said aggregate material processing device to be displaced, horizontally, from a location proximate said supply of unsorted aggregate material to a first location;

causing said aggregate material processing device to move in a vertical direction a first amount into said first aggregate material sorting position so as to cause said aggregate material remaining on said top region of said aggregate material sized sorting device to fall into a first sorted aggregate material store at said first location;

causing said aggregate material processing device to be displaced, horizontally, from a location proximate said first sorted aggregate material store to a second location; and causing said aggregate material processing device to move in a vertical direction a second amount greater than said first amount whereby said aggregate material processing device is moved into said second aggregate material sorting position causing said aggregate material sized sorting device to be pivotably displaced away from said material holding region opening and further causing said sorted aggregate material located in said aggregate material holding region to fall from said aggregate material holding region into a second sorted aggregate material store at said second location.

2. The method of claim 1 wherein said aggregate material processing device is an excavator.

3. The method of claim 2 wherein said aggregate material holding region includes an excavator bucket.

4. The method of claim 3 wherein said excavator bucket is configured to pivot about an axis coupling said excavator bucket to a support arm, and where in pivoting said excavator bucket about said axis causes said excavator bucket to move between an aggregate material holding region filling position, said first aggregate material sorting position and said second aggregate material sorting position.

5. The method of claim 4 wherein said excavator includes an aggregate material size sorting device retainer, configured to engage said aggregate material size sorting device, for maintaining said aggregate material size sorting device in a position generally way from said defined opening of said excavator bucket.

6. The method of claim 5 wherein said aggregate material size sorting device retainer includes a retaining clip.

7. The method of claim 6 further including after the act of causing said aggregate material processing device to move in a vertical direction into said second aggregate material sorting position causing said sorted aggregate material located in said aggregate material holding region to fall from said aggregate material holding region, the act of causing said excavator bucket to move about said axis toward said support arm and into a third position whereby said aggregate material size sorting device moves toward said support arm and engages with said aggregate material size sorting device retainer, to maintain said aggregate material size sorting device against said support arm and away from said defined opening of said excavator bucket.

8. The method of claim 7 further including after the act of causing said excavator bucket to move into said third position whereby said aggregate material size sorting device engages with said aggregate material size sorting device retainer, the acts of:

providing an aggregate material size sorting device retainer release, disposed on said support arm, said release device configured to contact said aggregate material size sorting device retainer, for releasing said retainer and allowing said aggregate material size sorting device to move into position in said opening of said excavator bucket;

moving said excavator bucket toward said support arm into a fourth position generally adjacent said support arm, such that said aggregate material size sorting device retainer release contacts said aggregate material size sorting device retainer thereby releasing it; and moving said excavator bucket away from said support arm toward said filling position thereby causing said aggregate material sized sorting device to pivotably move to a position over said defined opening of said excavator bucket.

9. The method of claim 1 wherein said aggregate material size sorting device includes a metal screen.

10. The method of claim 1 wherein said aggregate material size sorting device includes a plurality of openings, said plurality of openings having a generally uniform size determined by the size of aggregate material which is to be excluded from the sorted aggregate material holding device and remain on the top region of the aggregate material size sorting device.

* * * * *